United States Patent [19]

Mahler

[11] Patent Number: 5,004,462

[45] Date of Patent: Apr. 2, 1991

[54] ADJUSTABLE WATER-LEVEL FLUSHING APPARATUS

[76] Inventor: Leo M. Mahler, 8 E. Gainsborough Rd., Thousand Oaks, Calif. 91360

[21] Appl. No.: 488,149

[22] Filed: Mar. 5, 1990

[51] Int. Cl.[5] ..... E03D 1/14

[52] U.S. Cl. ..... 4/325; 4/382; 4/407; 4/415

[58] Field of Search ..... 4/324, 325, 369, 370, 4/379, 381, 382, 383, 404, 407, 403, 415

[56] References Cited

U.S. PATENT DOCUMENTS

| | | | |
|---|---|---|---|
| 2,270,989 | 1/1942 | Asselin | 4/382 |
| 2,883,675 | 4/1959 | Hartman, Jr. | 4/324 |
| 3,320,622 | 5/1967 | Wustner | 4/325 |
| 3,324,482 | 6/1967 | Wustner | 4/325 |
| 3,331,084 | 7/1967 | Wustner | 4/325 |
| 3,590,395 | 7/1971 | Wustner | 4/324 |
| 3,823,425 | 7/1974 | Coffman | 4/382 X |
| 4,000,526 | 1/1977 | Biela et al. | 4/325 X |
| 4,115,880 | 9/1978 | Gruenhagen | 4/325 |
| 4,175,296 | 11/1979 | Goldman | 4/325 |
| 4,225,987 | 10/1980 | Goldman et al. | 4/325 |

*Primary Examiner*—Henry J. Recla

*Assistant Examiner*—Robert M. Fetsuga

*Attorney, Agent, or Firm*—Albert O. Cota

[57] ABSTRACT

A toilet flushing apparatus (10) that conserves water by providing either a low-level water flush for liquid waste or a full-level flush for solid waste. The apparatus (10) consists of a water-level release assembly (12) that is attached to a toilet overflow tube (62) at the desired low water level. The assembly (12) includes an eccentric element (**12*c*) that decreases or increases a hose space (12*m*) located between the element and the overflow tube. Within this space is located an air vent hose (16) that has its lower end attached to a toilet flapper valve (14) and its upper end to a full- flush device (20). When the water level is above the assembly (12), the space (12*m*) decreases which occludes the hose (16) allowing the flapper valve (14) to remain buoyant and the flush to continue. When the water level drops to the level of the assembly (12), the space (12*m*) increases which removes the hose occlusion allowing the air vent hose (16) to vent which then allows the valve to drop and stop the flush. To circumvent the low-level flush, the full-flush device (20) is activated prior to flushing. The device occludes the hose (16**) for a brief period to allow a full-flush to occur.

10 Claims, 5 Drawing Sheets

ADJUSTABLE WATER-LEVEL FLUSHING APPARATUS

TECHNICAL FIELD

The invention pertains to the general field of sanitary toilet flushing apparatuses and more particularly to an adjustable water-level flushing apparatus that allows the user to select the quantity of water available for the flush.

BACKGROUND ART

The modern toilet in use today consists of two main parts, the upper part which holds water, referred to as a tank section, and the lower part consisting primarily of a bowl with a volume of water which is designed to receive human waste products. Once the waste products have been deposited in the bowl, they are removed by releasing the water held in the upper tank section into the bowl which, through a specially designed system, removes the waste products to a collection system, such as a sewer system or septic tank, and then refills the bowl so that there is left standing a volume of water. Waste consists of solid and liquid wastes and in presently available toilets, one flush is utilized to carry away both solid and liquid wastes, even for occasions when there is only liquid waste in the toilet bowl. In these standard toilets, a full complete flush is effected with each flush and the total contents of the water holding tank is drained into the bowl and then out into the sewer system.

One of the most popular toilet flushing apparatuses uses a ball-cock valve assembly that controls the inlet of water into the toilet water tank. A float ball is connected to the ball-cock valve by means of a float arm. As the toilet tank fills with water, the buoyant float ball rises in the tank section, the motion being transmitted to the ball-cock through the float arm until at a predetermined water level the ball-cock assembly shuts off the water inlet to the tank. This corresponds to a generally horizontal position of the float arm. In most toilets, the water level in the water tank may be adjusted by means of a screw set mechanism provided in the ball-cock assembly. This adjustment, however, is limited in range and requires that the tank lid be lifted to obtain access to the ball-cock. Once the water level in the tank is set, the adjustment is usually thereafter ignored. The same volume of water is therefore discharged from the tank every time that the flush apparatus is tripped, regardless of the volume which may be actually required on a particular occasion in order to successfully flush the toilet.

It is a well known fact that the largest use of water in most households and in many office buildings is for flushing toilets. Because the flushing is carried out with the full capacity of the water in the water tank, the water usage is wasteful and is not required. Considerate interest has been centered on reducing the water used when toilets are flushed, especially at times and in places when there is a water difficiency or periods of drought.

Several water saving methods have been used to conserve water during the toilet flushing operation. One such method has been to deposit a filled water bag or a solid object, such as a brick, in the water tank to displace an equivalent volume of water in the tank, to thus reduce the volume of water consumed with each flushing. Another common method is to lower the float valve to allow the ball-cock valve to close at a reduced water level. These methods to save water in many cases are self-defeating, in that, the effectiveness of the flush is diminished and it may be necessary to flush twice to effect a sanitary flush. Additionally, such methods represent a compromise in that the volume of water is set and is not readily adjustable.

A search of the prior art did not disclose any patents that read directly on the claims of the instant invention however, the following U.S. patents were considered related:

| U.S. PAT. NO. | INVENTOR | ISSUED |
|---|---|---|
| 4,837,867 | Miller | 13 June 1989 |
| 4,700,413 | Lopez | 20 October 1987 |
| 4,483,024 | Troeh | 20 November 1984 |
| 4,145,775 | Butler | 27 March 1979 |

The Miller patent discloses a dual flush system for toilets to effect a main flush or a partial flush of the toilet to carry away liquid wastes. The system functions by partially opening the main valve located in the water holding tank of the toilet for a period of time that is determined by the operator. When the valve is opened slightly, downward pressure on the valve and suction forces the water passing between the valve and valve seat to exert a downward force on the valve that causes the valve to pull back into a closed position after opening. Only when the valve is raised to a position where its buoyancy exceeds the downward pressure is a full flush effected. The system includes the means to limit the upward lifting of the valve by limiting the lengthwise travel of a cord attached to the valve. The cord is attached on its other end to a flush handle and lever.

The Lopez patent discloses a toilet flushing mechanisms that provides high and low water volume selectability. The invention consists of an articulated float arm that is normally bent at an angle by a detent mechanism to maintain a low water level in the toilet water tank. A linkage is provided to the exterior of the tank for releasing the detent mechanism. When so released, the buoyant float straightens the arm thereby admitting additional water into the tank to obtain a more ergorous flushing action.

The Troeh patent discloses a variable flush for a toilet water tank wherein the valve is operated by the same toilet trip lever as the usual single level types. The operational differences, presented by the invention, is that a light pressure on the toilet trip handle causes the two-level flush valve to yield a small flush whereas a heavier pressure will cause a full flush. The invention includes a first float connected to the outer end of the valve arm to maintain the valve in an open position until the water level falls below a predetermined level. A second float is carried on a float arm pivoted intermediate its ends to the support.

The Butler patent discloses a toilet water saving device in the form of flow control valve. The valve may be installed in the refill tube for the toilet bowl of a water tank, and is adjusted to establish the proper amount of refill water to flow into the toilet bowl after each flush, so as to avoid wasting water. The device may also be mounted directly on the main toilet valve unit as a built-in item for newly manufactured toilets.

DISCLOSURE OF THE INVENTION

The adjustable water-level toilet flushing apparatus allows a person using a toilet to select either a low-level flush reconnected for liquid waste or a full-level flush for solid waste. The apparatus is normally set to provide the low-level flush. However, the low-level flush can be easily circumvented by activating a first or second full flush device prior to flushing the toilet.

The basic apparatus which is disclosed in the first embodiment, consists of a water-level release assembly, a modified toilet flapper valve, an air vent hose, an air vent hose securing clamp and either the first or second full flush device.

The water-level release assembly consists of a float that is attached to an articulated eccentric element. The eccentric element is designed to decrease or increase a hose space that is located between the eccentric section and the toilet overflow tube. Within this space is located the air vent hose that has its lower end attached to a bore located on the flapper valve and its upper end attached to either the first or second full-flush device. When the water level is above the water-level release assembly, the hose space decreases which occludes the air vent hose. When the hose is occluded, the air in the flapper valve is trapped allowing the valve to remain buoyant which allows the flush to continue. Conversely, when the water level drops to the level of the assembly, the hose space increases which removes the hose occlusion. With the occlusion removed, the air vent hose vents to the atmosphere. The vented hose allows the trapped air in the flapper valve to be replaced with water which then causes the valve to drop into and seal the toilet tank drain and thus stop the flush.

When solid waste is to be flushed, the low-level flush can be easily circumvented with the recommenced full-level flush. This circumvention is accomplished by first activating the full level flush device prior to flushing the toilet. When the device is activated, the air vent hose is occluded for a brief period (5 to 6 seconds) which is sufficient time to override the assembly and provide the selected full flush.

The adjustable water-level toilet flushing apparatus is also disclosed in a second embodiment. This second embodiment differs from the first in that four or five water levels may be selected for the low-level flush. The selection is easily and quickly made by manually grasping and placing a water-level pull rod in a detented position that corresponds to the selected water level. In view of the above disclosure, it is the primary object of the invention to provide an apparatus that allows a toilet user to select either a low-level toilet flush or a full-level flush. In addition to the primary object, it is also an object of the invention to provide an apparatus that:

- saves water while retaining the effectiveness of the flush for sanitation purposes,
- is easily installed and requires no adjustments and/or periodic service that is beyond the ability of the average home owner,
- can be used to modify existing toilets or can be built-in to newly manufactured toilets,
- is simple to use,
- is cost effective from both a manufacturing and consumer viewpoint,
- does not require any modifications to the water holding tank, and
- is designed with components that are not subject to wear to thus provide a high reliability apparatus.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
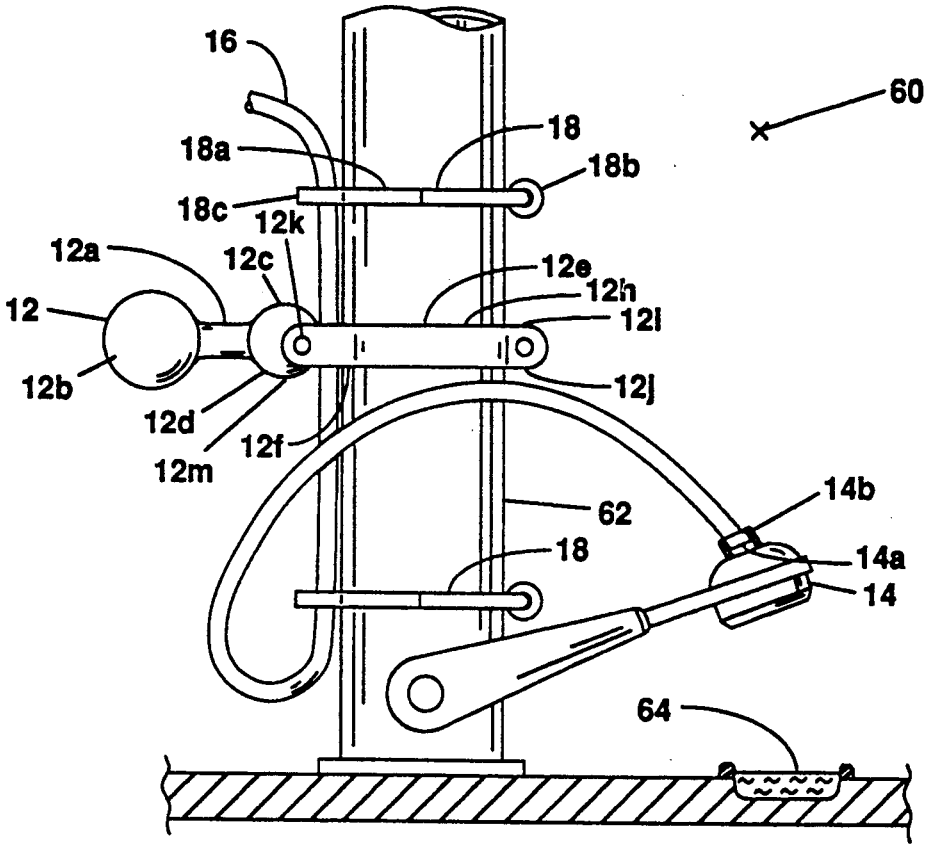
FIG. 1 is a partial side view of the first embodiment of the adjustable water-level toilet flushing apparatus.

The best mode for carrying out the invention is presented in terms of a basic first embodiment and a modified second embodiment. Both embodiments of the adjustable water-level toilet flushing apparatus 10 are designed to allow the user to select either a low-level flush for liquid waste or a full-level flush for solid waste.

The first embodiment, as shown in FIGS. 1 through 6 is comprised of the following major elements: a water-level release assembly 12, a modified toilet flapper valve 14, an air vent hose 16, an air vent hose securing clamp 18, and a first full-flush device 20, or a second full-flush device 22. The first embodiment of the apparatus 10 is used with a conventional toilet assembly consisting of a toilet water tank 60 that includes an overflow tube 62 and a toilet tank drain 64 that drains into a toilet bowl.

The water-level release assembly 12 is designed to allow a toilet to normally be flushed at a low-water level. The assembly is attached to a structural element of an existing toilet flushing mechanism located within a toilet water tank 60 and preferably, it is attached to the overflow tube 62, as shown in FIG. 1. The assembly has the means to decrease a hose space **12*m*, located between the assembly 12 and the outer wall of the overflow tube 62**, when the water level is above the assembly and conversely, to increase the hose space when the water level drops to the level of the assembly.

Figure 2:
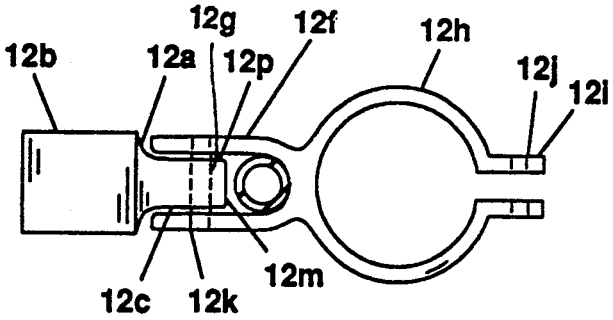
FIG. 2 is a top view of the water-level release assembly as configured for the first embodiment.

In a preferred embodiment, the water-level assembly 12, as shown in FIGS. 1 and 2 consists of an articulated section **12*a* and a stationary section 12*e*. The articulated section has on one end a float 12*b* and integrally attached on the other end an eccentric element 12*c* that includes on each side a pivot pin 12*d*. The stationary section 12*e* includes on one end a clevis 12*p* that has on each side a pivot pin bore 12g that pivotally accepts the pivot pins 12d on the eccentric section 12c. On the other end of the stationary section is integrally located an overflow tube clamp 12h. The clamp is sized to fit over the overflow tube 62 and is tightened against the tube by having the clamp include a pair of clamp flanges 12i that have flange bores 12j therethrough. The tightening is accomplished by inserting into the bores 12j, a bolt and nut combination 12k**.

The flapper valve 14 is modified by cutting an air vent bore 14a into its upper surface. In a preferred embodiment, a hose nipple 14b sized to hermetically accept the lower end of the air vent hose 16 is attached to the bore 14a as shown in FIG. 1.

Figure 3:
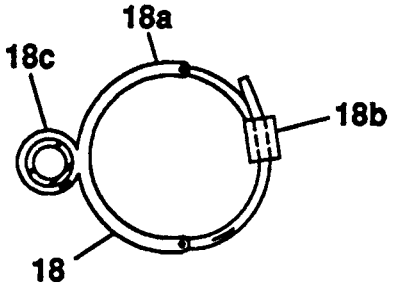
FIG. 3 is a top view of a typical air-vent hose and overflow tube clamp.

The air vent hose 16 is routed upwardly against the outer wall of the overflow tube 62 as shown in FIG. 1. The hose, in its upwardly travel, is placed within the hose space 12m located between the eccentric section of the water-release assembly 12 and the outer wall of the overflow tube 62. By so placing the hose, when the water level is above the assembly 12 the eccentric section moves in a direction that decreases the hose space 12m and occludes the hose to trap the air within the hose. With the air trapped, the modified toilet flapper valve 14 remains buoyant allowing the water in the toilet water tank to drain. Conversely, when the water level drops to the level of the assembly 12, the hose space increases to remove the hose occlusion. With the hose not occluded, the air in the hose is vented to the atmosphere which allows the trapped air in the modified flapper valve 14 to be replaced by water which then causes the valve to drop into and seal the toilet tank drain 64 located on the toilet water tank 60 and stop the flush. The air vent hose 16 is secured to the outer wall of the overflow tube 62 by an air vent hose securing clamp 18 as shown in FIGS. 1 and 3. The clamp consists of an overflow tube clamp 18a and a hose retaining ring 18c. The ring is sized to slideably accept and hold the air vent hose 16. The tube clamp 18a preferably includes a ratchet slip tie 18b that allows the clamp to be positioned and tightened around the overflow tube 62.

The apparatus 10 is normally set to provide a low-level flush which is recommended when flushing liquid waste. However, if solid waste is to be flushed, a full-level flush is recommended. To selectively circumvent the low-level flush and allow a full-level flush, either the first full-level flush device 20 or the second full-flush device 22 is activated prior to flushing.

Figure 4:
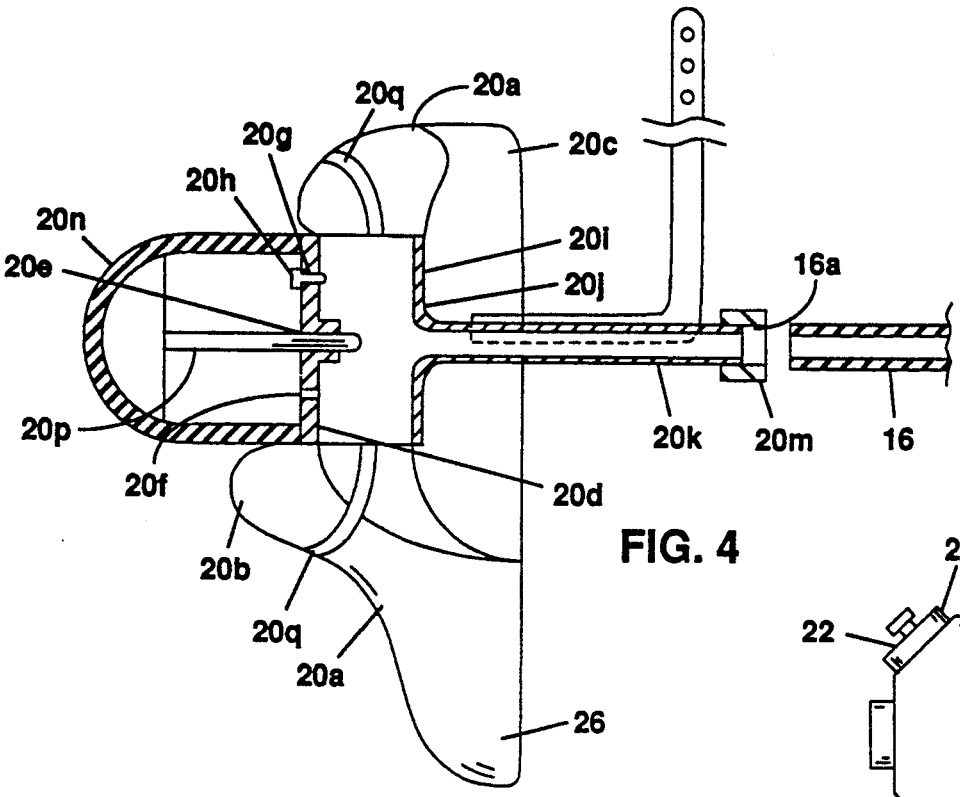
FIG. 4 is a side cross-sectional view of the first full-flush device as installed in a typical lever type toilet flushing assembly.

The first full-flush device 20 as shown in FIG. 4, consists of a housing 20a, that has a front end 20b, a back end 20c and at least one vent bore 20q that vents to the atmosphere. Inserted and attached to the front end 20b of the housing is a support structure 20d that includes: a plunger bore 20e therethrough, at least one air-bleed bore 20f and a valve bore 20g into which is inserted and attached a check valve 20h.

To the back of the housing 20a is attached a plate 20i that has a central bore 20j. Into the bore 20j is inserted and hermetically attached an outwardly extending combination plunger socket and extension tube 20k that includes a hose nipple 20m. As shown in FIG. 4, the upper end 16a of the air vent hose 16, from FIG. 1, is attached to the nipple 20m. To the front of the housing 20a is hermetically attached a resilient dome 20n preferably made of a rubber material.

The final element that comprises the first full-flush device 20 is an air control plunger 20p that has one end centrally and rigidly attached to the inside of the resilient dome 20n. The other end of the plunger 20p is sized to fit into the plunger guide bore 20e which includes a hermetic seal and is located on the support structure 20d. The plunger remains outside the plunger socket 20k when the dome 20n is in its normal extended position. In this position, the air passage through the air vent hose 16 is cleared to allow the air to vent into the atmosphere via the vent bores 20q thus, the water-level release assembly is in control to provide a low-level flush. When the dome 20n is pressed, air escapes through the check valve 20h and the plunger 20p enters the plunger guide socket 20e to seal the air passage of the air vent hose. With the air sealed, the flapper valve 14 remains buoyant allowing the low-level flush to be circumvented and a full-level flush is effected. The dome remains in its depressed position for a short duration (5 to 6 seconds) before the air is returned through the air bleed bore 20f. The bore 20f controls the air flow rate into the dome area which, in turn, determines the time duration required for the dome to return to its normal extended position. In a full-flush or low-level flush, once the flapper valve 14 drops into the seal 64, all the residual water in the valve is voided and the space is replaced with air.

Figure 5:
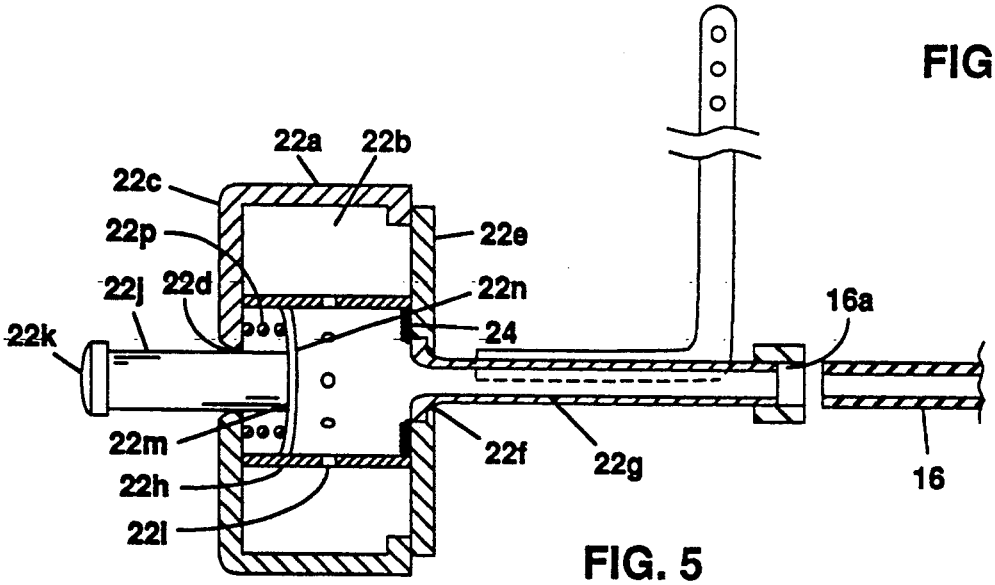
FIG. 5 is a side cross-sectional view of the second full-flush device.

The second full-flush device 22, as shown in FIG. 5, consists of a housing 22a that has an open back section 22b and a front section 22c having a plunger bore 22d therethrough. Hermetically attached to the open back section 22b is a back plate 22e that includes a bore 22f into which is hermetically attached a hose nipple 22g. The nipple is sized to accept the upper end 16a of the hose 16. Between the back section 22b and front section 22e of the housing is centrally located a cylinder 22h that has a plurality of circumferentially located vent bores 22i as shown in FIG. 5.

The device 22 also includes a plunger 22j having a front end 22k and a back end 22m that extends through the plunger bore 22d on the front section 22c of the housing 22a. To the back end 22m of the plunger 22j is attached a resilient piston 22n that is sized to slideably fit into the cylinder 22h. Around the plunger 22j between the back of the resilient piston 22n and the back of the front section 22c is located a spring 22p. The spring is attached to the front section 22c to normally maintain the piston 22n near the back of the front section as shown in FIG. 5. When so maintained, the air in the air vent hose 16 vents into the atmosphere via the vent bores 22i, and the water-level release assembly is in control to provide a low-level flush. When the plunger is pressed, the piston 22n moves past the vent bores 22i and seals the air passage of the vent hose 16. The hose remains sealed for the period of time (5 to 6 seconds) that is required by the combination of the spring 22p and the friction of the cylinder 22h to cause the piston to return to its normal position. While the hose is occluded, the flapper valve 14 remains buoyant allowing the low-level flush to be circumvented and a full-level flush is effected. In a full-flush or low-flush, once the flapper valve 14 drops into the seal 64, all the residual water in the valve is voided and the space is replaced with air.

In the second full-flush device 22, to increase the time delay before the piston 22n returns to its normal position, a resilient sticky substance 24 may be applied around the bore 22f on the back plate 22e as shown in FIG. 5. When the piston is pressed against the sticky substance, the piston 22n temporarily sticks to the substance for a brief period before the piston is released to return to its normal position.

Figure 6:
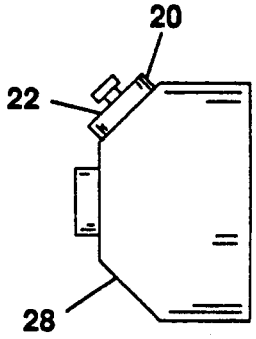
FIG. 6 is a side view of a typical push-button type toilet flushing assembly adapted to incorporate a full-flush device.

Both the first and second full-flush devices 20, 22 may be located on one side of a lever type toilet flushing assembly as shown in FIG. 4 or on one side of a push-button toilet flushing assembly as shown in FIG. 6. Also, note that the first and second full-flush devices are given as examples only, since other delay-type full flushing devices that utilize springs, rubber plungers, and other implements may also be used.

Figure 7A:
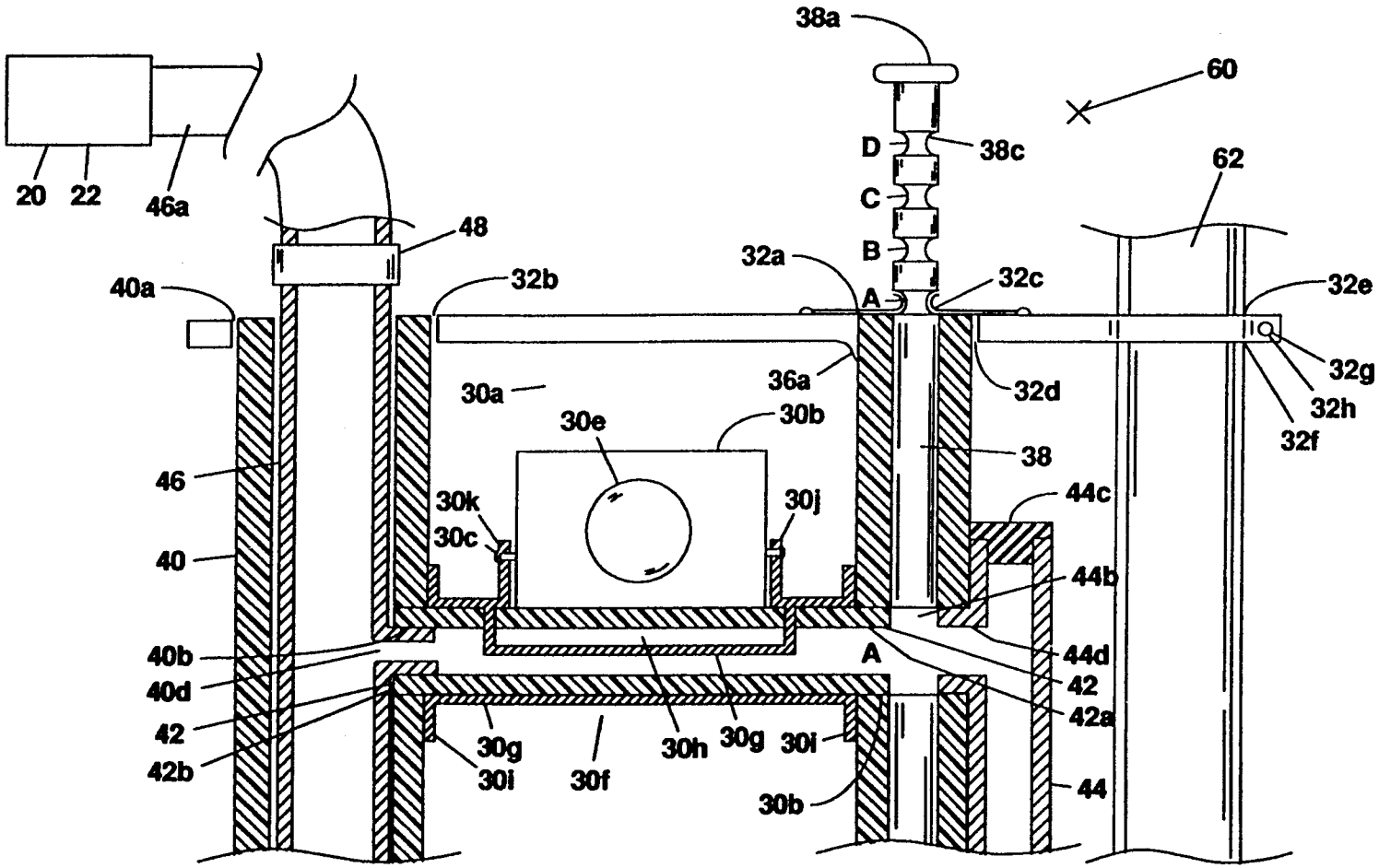
FIG. 7 (Part A and B) is a partial schematic of the second embodiment of the adjustable water-level release assembly.
Figure 7B:
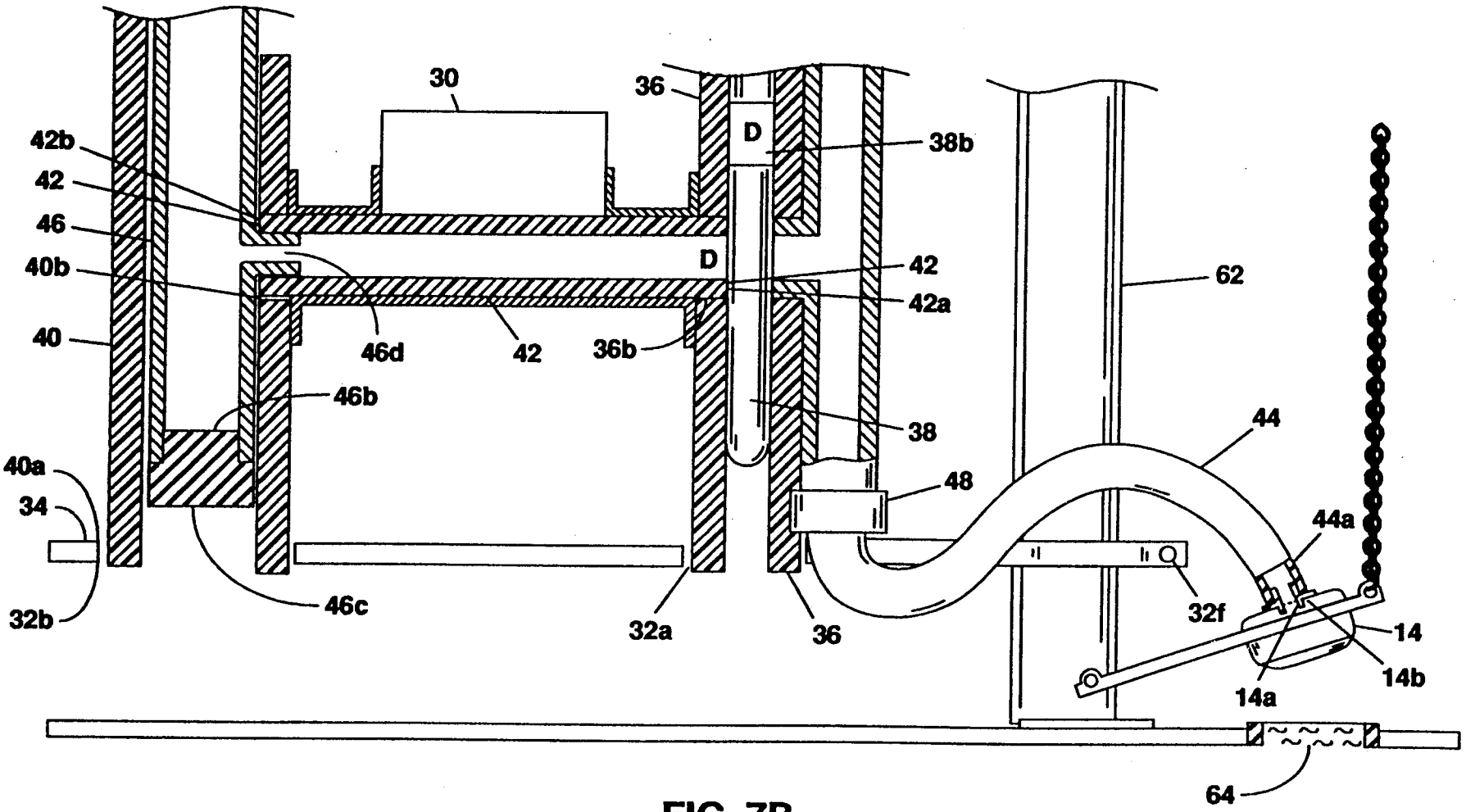

The second embodiment, as shown in FIGS. 7 through 10, is comprised of the following major elements: a water-level release assembly 30, an upper apparatus clamp 32, a lower apparatus clamp 34, a pull-rod support tube 36, a water valve pull rod 38, an air-vent hose support tube 40, an interface hose 42, a modified toilet flapper valve 44, a flapper hose 46 and an air vent hose 48. The second embodiment of the apparatus 10 is also used with a conventional toilet assembly consisting of a toilet water tank 60 that includes an overflow tube 62 and a toilet tank drain 64 that drains into a toilet bowl 66. The second embodiment differs from the first in that the water level of the low-level flush can be quickly and easily selected. To provide this selectable water capability, a plurality of water-level release assemblies 30 are employed as shown in FIG. 7.

Figure 8:
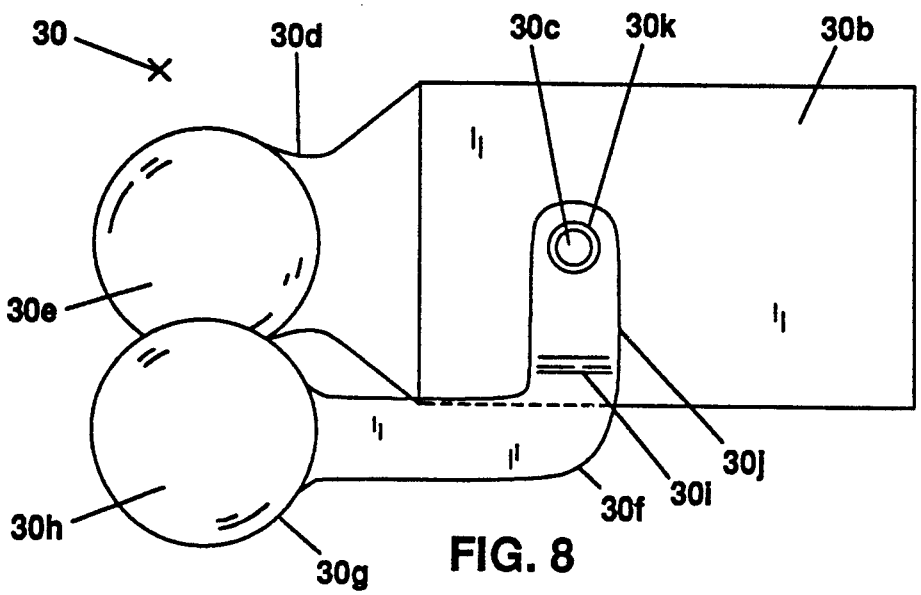
FIG. 8 is a side view of the water-level release assembly used with the second embodiment.
Figure 9:
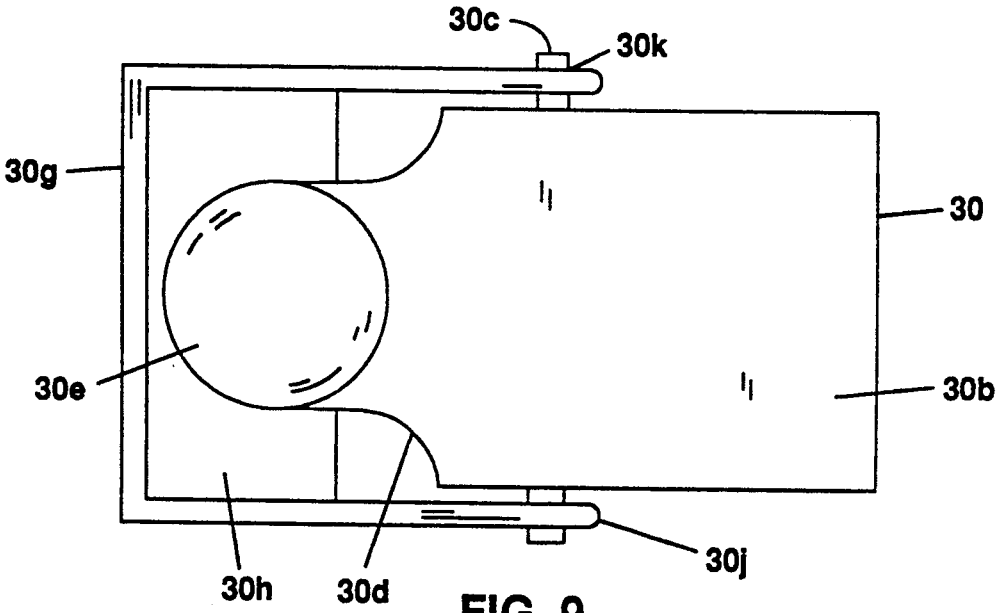
FIG. 9 is a top view of the water-level release assembly used with the second embodiment.
Figure 10:
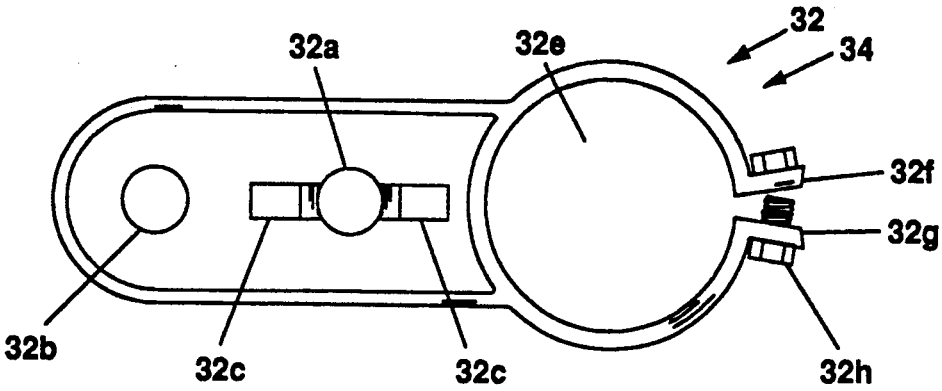
FIG. 10 is a top view of the upper apparatus clamp used with the second embodiment.

The water-level release assembly 30, as with the water-level release assembly 12 is also designed to allow a toilet to normally be flushed at a low water level. Each assembly 30, as shown in FIGS. 7, 8 and 9 consists of an articulated section 30*a* and a stationary section 30*f*. The articulated section 30*a* includes a float 30*b* that has on each side a pivot pin 30*c*. On the front end 30*d* of the float 30*b* is a hose squeeze ball 30*e*. The stationary section 30*f* includes an interface hose support 30*g* that has an opening 30*h* that is in alignment with the surface of the hose squeeze ball 30*e*. On each end of the support is located an attachment bracket 30*i* that allows the support 30*g* to be attached, by an attachment means, to the inward sides of the pull-rod support tube 36 and the air-vent hose support tube 40 as shown in FIG. 7A. On each end of the support, parallel to the attachment bracket, is also located a pivot bracket 30*j*. Each pivot bracket has a pivot pin bore 30*k* that is sized to accept the pivot pin 30*c* to allow the articulated section to freely swing about the pivot pin.

The apparatus 30 is attached to the overflow tube 62 by means of an upper and a lower apparatus clamp 32, 34. The upper apparatus clamp 32 as shown best in FIG. 10, has on one end an air-vent hose support tube bore 32*a*, and near its center is a pull-rod support tube bore 32*b*. Near the periphery of the bore 32*b*, at each opposite side, is located a detent clip 32*c*. On the end of the overflow tube opening is located a tightening means that preferably is accomplished by having an apparatus clamp that has a pair of clamp flanges 32*f* that include flange bores 32*g*. When the clamp is placed over the overflow tube 62 a bolt and nut combination 32*h* is inserted into the flange bores 32*g* to effect a tightening. The lower apparatus clamp 34 is similar to the upper apparatus tube with the exception that it does not include the detent clips 32*c*.

Inserted through and attached, by an attachment means 36*a*, to the respective pull-rod support tube bores 32*a* on the upper and lower apparatus clamps 32, 34 is the pull-rod support tube 36. The upper end of the tube 36 is flush with the upper surface of the pull-rod support tube bore 32*b*. The lower end of the tube need not be flush with the bore 32*a* on the lower apparatus clamp 34. The tube 36 has a plurality of spaced, lateral hose bores 36*b* therethrough. On FIG. 7, two such bores are typically shown, however, preferably 3 to 4 hose bores 36*b* may be included to optimize the utility of the invention.

The pull-rod support tube 36 is sized to allow the water valve pull rod 38 to be slideably inserted as also shown in FIG. 7. The pull rod 38 includes a handle 38*a* on its upper end and has a plurality of spaced, lateral air-passage bores 38*b* therethrough that are in alignment with the plurality of the hose bores 36*b* on the pull-rod support tube. On the upper section of the pull rod 38, as shown in FIG. 7, is inserted a set of concave detents 38*c* that are spaced accordingly and equal in number to the plurality of the air-passage bores 38*b*.

When the pull rod 38 pulled fully upwardly, the lowest or first (A) concave detent 38*c* is held by the detent clips 32*c*. In this configuration, the upper most or first (A) air passage bore 38*b* is in alignment with the upper most or first hose bores 36*b* on the pull-rod support tube 36 while the remaining air passage bores 38*b* are air sealed. When the pull rod 38 is lowered, so that the second (B) concave detent 38*b* is held by the detent clips 32*c*, the second air-passage bore 38*b* is in alignment with the second hose bores 36*b* on the support tube 36 (the second air-passage bore 38*b* is not shown in FIG. 7). At this time, the first air passage bore is now located between the first and second hose bores 36*b* on the pull rod support tube 36 and is air-sealed as are the other air passage bores as typically shown as position (D) in FIG. 7.

Inserted through and attached by an attachment means 40*a*, to the respective air-vent hose support tube bores 32*b* on the upper and lower apparatus clamps 32, 34 is the air-vent hose support tube 40. The tube 40 has in alignment with the bores on the pull-rod support tube 36 an equal plurality of lateral hose bores 40*b* that project through its inner wall as shown in FIG. 7.

To connect the air passage from the pull-rod support tube 36 and the air-vent hose support tube 40, an interface hose 42 is employed. This hose has a first end 42*a* that projects through the respective inner hose bores 36*b* on the pull-rod support tube and a second end 42*b* that projects through the respective inner hose bores 40*b* on the air-vent hose support tube 40. The interface hose 42 is inserted and cradled by the interface hose support 30*g* of each water level release assembly 30 as shown in FIG. 7.

As with the first embodiment, the second embodiment uses a toilet flapper valve 14 that is modified by cutting an air vent bore 14*a*. Into this bore is preferably and hermetically attached a hose nipple 14*b* that is sized to accept the lower end 44*a* of the flapper hose 44.

The flapper hose 44 is air sealed by inserting a cap 44*b* into its upper end 44*c*. On the side of the hose, there is located, in alignment with the lateral hose bores 36*b* on the pull-rod support tube 36, an equal plurality of lateral lipped hose bores 44*d* that project outwardly from its wall. The lipped bores 44*d* are inserted into the corresponding plurality of the hose bores 36*b* on the outer side of the pull-rod support tube 36.

The final hose that completes the air passage from the flapper valve 14 to the first or second full-flush device 20, 22 is the air vent hose 46. The hose 46 is located within the air-vent hose support tube 40 and has an upper end 46*a* and a lower end 46*b* that is air sealed by inserting into its opening a cap 46*c* as shown in FIG. 7.

On the inward side of the hose 46, in alignment with the hose bores **40*b* on the air-vent hose support tube 40, is located an equal plurality of lateral lipped hose bores 46*d* that project outwardly from its wall. The lipped bores are inserted into the corresponding plurality of the inner hose bores 40*b* on the air vent support tube and into the second end 42*b* of the interface hose 42**.

The upper end of the air vent hose 46 is inserted into either the hose nipple **20*m* of the first full-flush device 20 or to the hose nipple 22*g* of the second full flush device 24**.

The operating principle of the second embodiment is identical to that of the first embodiment. The basic difference between the two is that in the second embodiment the low-level water for flushing can be easily selected by placing the water valve pull rod at the desired water level. Once the level is selected, the applicable water level release assembly 30 controls the toilet flushing action.

When the water level is above the float **30*b* of the assembly 30 the hose squeeze ball 30*e* exerts a pressure on the interface hose 42 that occludes the hose. In this condition, the air in the air passage is trapped which allows the modified flapper valve 14 to remain buoyant and allow the flushing action to continue. Conversely, when the water level reaches the level of the assembly, the back of the float 30*b* moves downwardly causing the squeeze ball 30 to move upwardly and ceases the pressure being applied on the interface hose 40. With the interface hose occlusion removed, the air passage is cleared so the air in the air vent hose 46 vents to the atmosphere which allows the trapped air in the flapper valve 14 to be replaced with water that then causes the valve 14 to drop into and seal the toilet bowl drain 64** and stop the flush.

The apparatus 10 that utilizes the second embodiment is normally set, as with the first embodiment, to provide a low-level flush. To circumvent the low-level flush and allow a full level flush either the first or second full-level flush assemblies 20, 22 are activated prior to flushing. To connect into either of these assemblies, the air vent hose 46 is connected to the applicable hose nipple on the devices. The operator of the apparatus with either of the devices is identical to that described for the first embodiment.

While the invention has been described in complete detail and pictorially shown in the accompanying drawings, it is not to be limited to such details, since many changes and modifications may be made to the invention without departing from the spirit and the scope thereof. For example, a hose interface connector 48 may be located at various hose points to facilitate the assembly and installation of the apparatus 10; additionally, with the exception of the hoses, the apparatus may be constructed of metal or plastic with plastic preferred, hence, it is described to cover any and all modifications and forms which may come within the language and scope of the claims.

I claim:

1. An adjustable water-level toilet flushing apparatus for use in a toilet water tank having a hollow flapper valve pivotally attached to an overflow tube and a drain with a valve seat, said apparatus comprising:

(a) a water-level release assembly adapted to be attached to the overflow tube at a level selected to effect a low-level flush, said assembly having first occluding means to occlude a hose, located between said assembly and the outer wall of the overflow tube, when the water level is above said assembly and conversely, to remove the occlusion the hose when the water level drops to the level of said assembly, (b) a modified toilet flapper valve having an air vent hose bore on its upper surface, (c) an air vent hose having an upper end, and a lower end that is inserted into and hermetically attached by an attachment means, to the air vent hose bore on said toilet flapper valve, where said hose is routed upwardly and through said first occluding means such that when the water level is above said assembly the hose is occluded to trap air and allow the toilet flapper valve to remain buoyant and conversely, when the water level drops to the level of said assembly, the occlusion is removed from the hose to allow said hose to vent at which time, the toilet flapper valve prematurely drops to seal the drain in the toilet water tank, and (d) means to selectively circumvent the low-level flush and allow a full-level flush by controlling the passage of air via second occluding means connected to the upper end of said air-vent hose such that when the upper end is occluded, the air trapped in said air vent hose maintains the toilet flapper valve buoyant and conversely, when the occlusion is removed, said hose is vented, and the toilet flapper valve drops to seal the drain in the toilet water tank.

2. The apparatus as specified in claim 1 wherein said first occluding means comprises:

(a) an articulated section having on one end a float and on the other end an eccentric element that includes on each side a pivot pin, and, (b) a stationary section that includes on one end a clevis having pivot pin bores therethrough that pivotally accept the pivot pins on said eccentric section, and on the other end an overflow tube clamp that is sized to fit over and be tightened against the overflow tube.

3. The apparatus as specified in claim 2 wherein said overflow tube clamp includes a pair of clamp flanges each having a flange bore therethrough, and a bolt and nut combination inserted into the flange bores to effect a tightening.

4. The apparatus as specified in claim 1 wherein said means to attach said air vent hose to said toilet flapper valve comprises a hose nipple hermetically sealed to said flapper valve and sized to hermetically accept the lower end of said air vent hose.

5. The apparatus as specified in claim 1 further comprising an air vent hose securing clamp adapted to secure said air vent hose to the outer wall of the overflow tube where said clamp consists of an overflow tube clamp and a hose retaining ring attached to the side of the tube clamp, where the ring is sized to slideably accept said air vent hose and where the tube clamp includes a ratchet slip tie that allows the clamp to be positioned and tightened around the overflow tube.

6. The apparatus as specified in claim 1 wherein said means to selectively circumvent the low-level flush and allow a full-level flush comprises a first full-flush device including:

(a) a housing having a front end, a back-end and at least one vent bore, (b) a support structure internally attached to the front end of said housing, said structure having:

(1) a plunger guide bore therethrough, (2) at least one air- bleed bore, and (3) a valve bore into which is inserted and attached a check valve, (c) a plate attached to the back end of the housing, the plate having a central bore into which is inserted and attached a combination plunger socket and extension tube that has on its rear end a hose nipple into which is inserted the upper end of said air vent hose, (d) a resilient dome attached to the front end of the housing where when the dome is pressed, air escapes through the check valve and the dome remains in its depressed position for a few seconds before the air is returned through the air bleed bore allowing the dome to return to its normal extended position, and (e) an air control plunger having one end centrally and rigidly attached to the inside of the resilient dome and the other end inserted through the plunger guide bore on the support structure, where the plunger remains outside the plunger socket when the dome is in its normal extended position allowing the air in said air vent hose to vent into the atmosphere via the vent bores, and conversely, when the dome is pressed the plunger enters the guide plunger socket to thus seal the air passage of said air vent hose for the period of time required for the air bleed bore to allow the resilient dome to return to its normal extended position.

7. The apparatus as specified in claim 6 wherein said first, full-flush device may be located on one side of a lever type toilet flushing assembly or on one side of a push-button toilet flushing assembly.

8. The apparatus as specified in claim 1 wherein said means to selectively circumvent the low level flush and allow a full-level flush comprises a second full-flush device including:

(a) a housing having an open back section and a front section having a plunger bore therethrough, (b) a back plate attached to the open back section of the housing and having a bore therethrough into which is hermetically attached a hose nipple into which is inserted the upper end of said air vent hose, (c) a cylinder having a plurality of circumferentially located vent bores and that is centrally located between the back section and front section of the housing, (d) a plunger having a back end that extends through the plunger bore on the front section of the housing, (e) a resilient piston attached to the back end of the plunger and sized to slideably fit into the cylinder, and (f) a spring located around the plunger between the front of the resilient piston and the back of the front section where the spring is attached to the front section and maintains the piston near the back of the front section where when so maintained, the air in said air vent hose vents into the atmosphere via the vent bores on the cylinder and conversely, when the plunger is pressed the piston moves past the vent bores and seals the air passage of said air vent hose for the period of time that is required, by the combination of the spring and cylinder, to cause the cylinder to return to its normal position.

9. The apparatus as specified in claim 8 wherein a resilient sticky substance is applied around the bore on the back plate where when the resilient piston is pressed against the substance, the piston temporarily sticks to the substance to provide a time delay before the piston returns to its normal position.

10. The apparatus as specified in claim 8 wherein said second full-flush device may be located on one side of a level type toilet flushing assembly or on one side of a push-button toilet flushing assembly.

* * * * *